US005183420A

United States Patent [19]

Hollander et al.

[11] Patent Number: 5,183,420

[45] Date of Patent: Feb. 2, 1993

[54] MOLDED CONNECTOR WITH SPOOL

[75] Inventors: Milton B. Hollander, Stamford; David R. Jacobs, Norwalk; William E. McKinley, Stamford, all of Conn.

[73] Assignee: Omega Engineering, Inc., Stamford, Conn.

[21] Appl. No.: 723,448

[22] Filed: Jun. 28, 1991

Related U.S. Application Data

[63] Continuation-in-part of Ser. No. 527,933, May 24, 1990, abandoned.

[51] Int. Cl.[5] ..... H01R 13/58

[52] U.S. Cl. ..... 439/457; 439/4; 439/695; 439/501

[58] Field of Search ..... 439/456–458, 439/470, 471, 501, 4, 692, 695, 696

[56] References Cited

U.S. PATENT DOCUMENTS 2,027,853 1/1936 Benander ..... 439/456
2,042,398 5/1936 Hile ..... 439/457
2,167,541 7/1939 Young ..... 439/501
2,204,939 6/1940 Lyons ..... 439/501

FOREIGN PATENT DOCUMENTS 12117 of 1911 United Kingdom ..... 439/457
23534 of 1914 United Kingdom ..... 439/458
564419 9/1944 United Kingdom ..... 439/458

*Primary Examiner*—David L. Pirlot
*Attorney, Agent, or Firm*—Bruce E. Hosmer; Howard S. Reiter

[57] ABSTRACT

A simple and effective means for improving mechanical resistance to stress at the coupling between a conductor and the connector is provided in a thermocouple connector which includes an integrally attached spool for storing in neat, compact and readily accessible form, the excess length of electrical conductor which is attached to the connector while providing the resistance to the stress.

4 Claims, 3 Drawing Sheets

MOLDED CONNECTOR WITH SPOOL

This application is a continuation-in-part of U.S. pantent Ser. No. 07/527,933 filed May 24, 1990 now abandoned by Milton B. Hollander, David R. Jacobs and William E. McKinley entitled Molded Connector With Spool.

This invention relates generally to electrical connectors, and more specifically to electrical connectors having a housing with provision for storing and anchoring a length of electrical conductor thereon.

Separable electrical connectors of the type having a female receptable portion with receiving contact elements, and a plug portion with extending male contact elements configured to be inserted into the mating receiving contacts on the receptacle portion, are well known in the art. The plug receptacle portions of such connectors generally comprise a housing or body portion formed of electrically insulating material, with one of more contact elements formed of electrically conductive material supported and positioned on the housing.

In use, one end of a flexible electrical conductor or cable is electrically coupled to each contact element and is mechanically coupled to either or both the contact element and the housing; the conductor extends a predetermined length from the connector portion so that the opposite end of the conductor may be coupled to an associated electrical device.

The size and shape of the halves or portions of a separable electrical connector often are adapted to reflect certain qualities of the electrical circuit devices which they are intended to connect and of the applications with which they are associated. Although connectors used with test and experimental devices such as thermocouples, often are reduced to "small" or "miniature" size in recognition of the limited space which may be available in crowded test sites, such connectors frequently are not otherwise specifically adapted to the requirements of such use.

When test circuit devices such as thermocouples are used, for example, it is often necessary to move then from location to location within a given test site, or to other test sites. Each time such a device is moved, it may be relocated at a different distance from the point at which the associated electrical connector must be coupled to a mating portion. The location of the mating portion may vary as well, requiring frequent disengagement and re-engagement of the mating portions. Such use tends to impose substantial stress on the mechanical coupling between the conductor and the connector. It necessitates finding accommodation for the excess length of conductor each time the distance between the utilization device and the connection point is shortened. It also requires convenient means for extending the conductor length when the distance is increased.

Accordingly, it is an object of this invention to provide an electrical connector which includes means for storing in neat, compact and readily accessible form, the excess length of electrical conductor which is coupled thereto.

Another object of this invention is to provide an electrical connector with simple and effective means for improving mechanical resistance to stress at the coupling between the conductor and the connector.

These and other and further objects, features and advantages of this invention will be made apparent to those of skill in this art by the following description, taken in connection with the accompanying drawings, in which.

Figure 1:
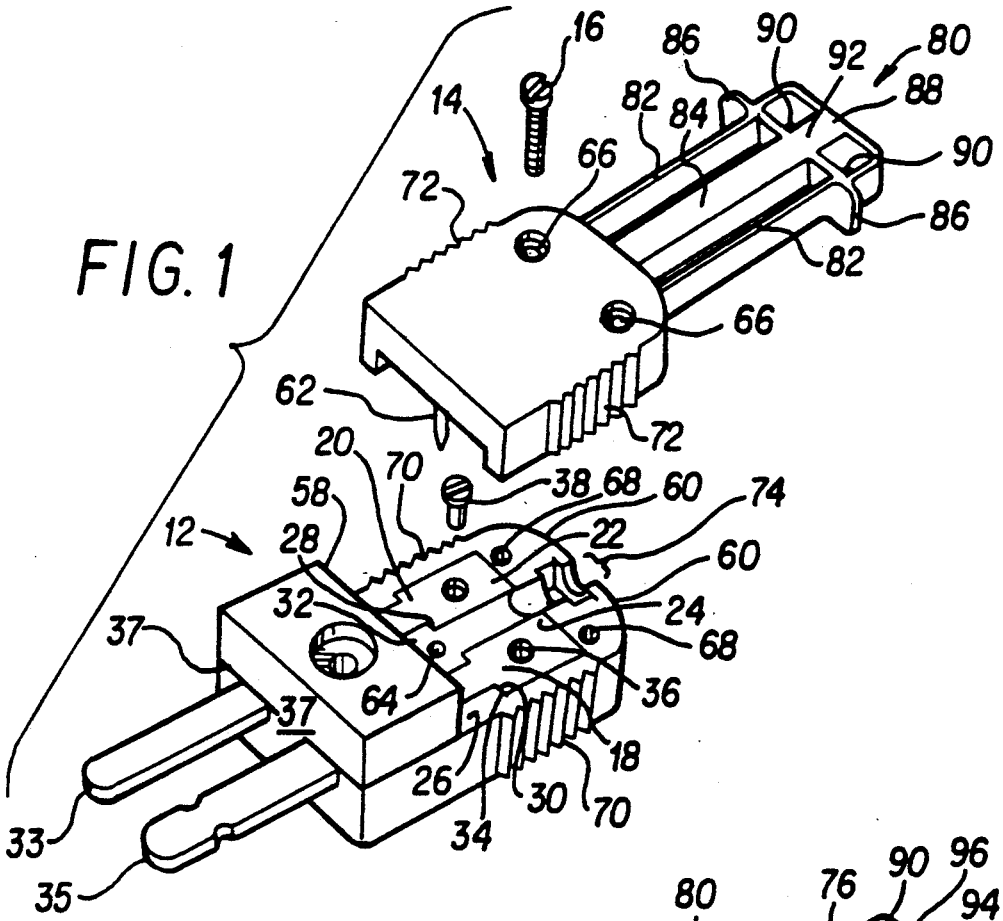
FIG. 1 is a partially exploded pictorial representation of a connector constructed in accordance with this invention.
Figure 3:
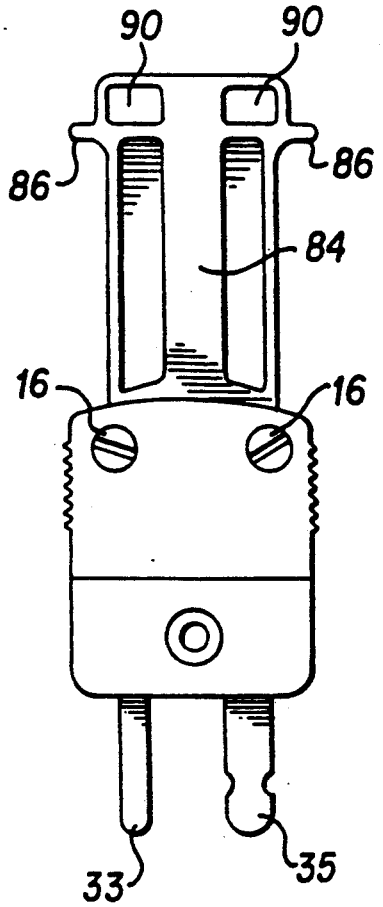
FIG. 3 is a plan view of the connector illustrated in FIG. 1 with the parts thereof fully assembled.
Figure 4:
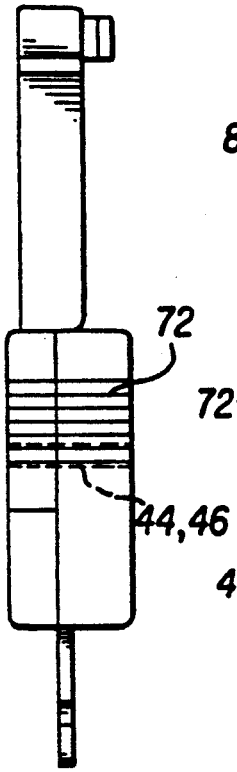
FIG. 4 is a side elevation view of the connector of FIG. 3.
Figure 5:
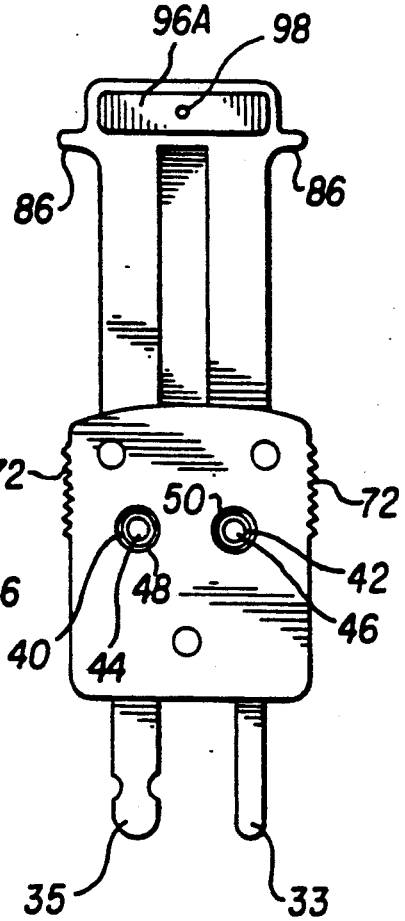
FIG. 5 is a plan view of the connector of FIG. 1 taken from the reverse side of FIG. 3.

Referring now more specifically to the drawings, an electrical connector in accordance with this invention is designated generally by reference numeral 10 in FIG. 1. The connector 10 has an elongated body defined by a contact supporting body member 12 and a cable supporting body member 14 which are separably attached together as shown in FIGS. 3, 4 and 5, by screws 16 or other suitable fastening means.

Contact supporting body member 12 is formed of electrically insulating material by any suitable molding or forming process. A pair of electrical contact elements 18, 20 are supported on the contact-supporting body 12 in generally spaced-apart parallel relationship for convenient axial engagement with a mating connector (not shown). The contact elements 18, 20 may be molded into the material of the supporting body 14 during the formation process in any well known manner, or they may be force-fitted or snap-fitted into suitable openings in the body. In an alternate from, body 12 may be formed in two longitudinally separated parts along line 37 in FIG. 1, to capture contacts 18, 20 between them before they are fastened together. Recesses 22, 24 in the mating face 26 of the body 14 are provided with opposed stop surfaces such as 28, 30 which cooperate with oppositely facing stop surfaces 32, 34 on one end of each contact to resist axial displacement of the contacts relative to the body 14. The opposite ends 33, 35 of contacts 18, 20 project from contact exposing face 37 at one axial end of body 12.

Each contact element 18, 20 is provided with a means such as openings 36, which receive screws 38 for securing an electrical conductor wire (not shown) to the contact element in the well known manner of an electrical screw terminal. The screw terminal 38 may be threadely engaged directly with the contacts 18, 20. But in the embodiment illustrated here, the contact supporting body member 14 is provided with a pair of conductive metallic inserts each having internally threaded openings 44, 46 positioned in alignment with the openings 36 in contacts 18, 20 for receiving screws 38 in threaded engagement through the openings 36. When a wire conductor is secured to contacts 18, 20 in this manner, an electrical path is established between and among contacts 18, 20, screws 36 and conductive inserts 40, 42.

As an added feature of this invention, conductive inserts 40, 42 extend through support body 14 and are accessible from the exterior thereof through recesses 48, 50. This structure facilitates electrical access to the contact elements 18, 20 for testing and circuit verification purposes.

Cable supporting body member 14 has a mating face 52 configured to lie in parallel, overlapping relationship with the mating face 26 of contact supporting body 12. First and second abutting surfaces 54, 56 on the cable supporting body are provided to position that body axially relative to corresponding first and second abutting surfaces 58, 60 on contact supporting body 12. To further position bodies 12 and 14, an alignment projection 62, in the form of a lance on body 14 is located and dimensioned to be received in a mating recess opening 64 in body 12.

When bodies 12 and 14 have been brought together and properly aligned by the interaction of abutting surfaces 54, 56 with corresponding abutting surfaces 58, 60 and the interaction of lance 62 with recess 64, the bodies may be removably secured against lateral separation by screws 16. The screws are inserted through suitable openings in body 14 and are threadely received in aligned openings 68 in body 12.

Textured gripping surfaces 70 on the lateral exterior surfaces of body 12 align with similar surfaces on the exterior of body 14 when the two bodies have been fastened together so as to facilitate handling of the connectors, especially during engagement and disengagement of mating portions.

A cable guiding recess 74 is provided at the end of the cable supporting body 12 remote from the contact supporting face 37, for permitting a cable or conductor to extend from between mating faces 26 and 52, to the exterior. An axially extending recess 76 in body 14 aligns and cooperates with cable-guiding recess 74 to facilitate emergence of a cable from between the mating faces 26, 52. In this manner, one or more conductor wires, coupled to contact 18, 20 by screw means 38, at mating face 26 on body 12, may be enclosed between faces 26 and 58. The wires may extend conveniently from the point where they are coupled to the contacts to the exterior of the connector 10. Recesses 78 in body 14 open into mating face 52 to accommodate the heads of screws 38. In addition to accommodating the heads of screws 38, recesses 78 provide clearance for the conductors (not shown) which are gripped by the screws for connection to contacts 18, 20.

Figure 2:
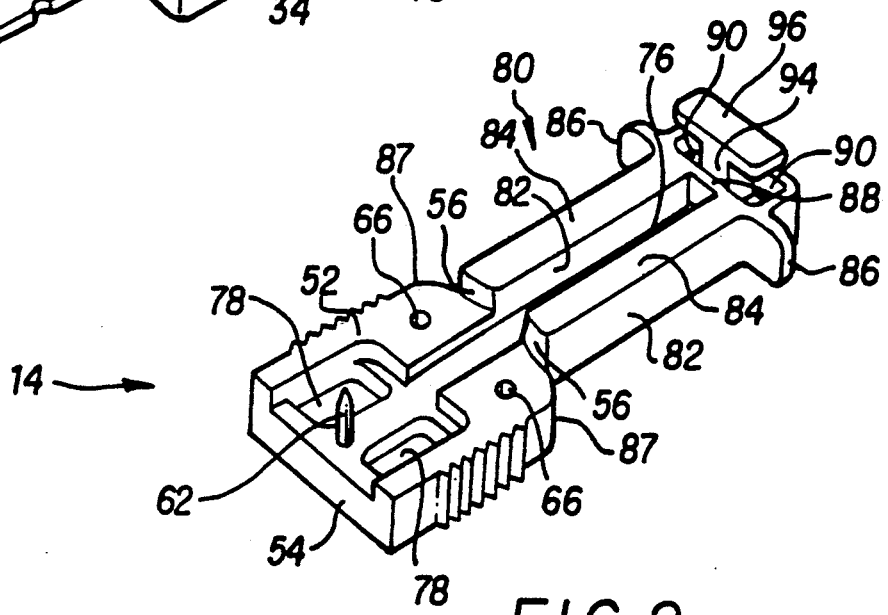
FIG. 2 is a pictorial representation of the reverse side of the upper connector element illustrated in FIG. 1.

Referring again to FIG. 2, conductor receiving member 14 may be seen to include an extending spool portion 80 at one end thereof. The spool portion has an elongate body defined by four side wall members 82 which are arranged in generally parallel spaced-apart relationship and are connected together by generally parallel alternately spaced floor web portions 84. The structure is similar to a corrugated beam, having optimum strength with minimum mass of material and correspondingly reduced weight.

Projecting from the remote end of spool portion 80, and forming integral lateral extensions of the outermost sidewalls 82 are a pair of pulling ears or shoulders 86 which provide gripping surfaces to facilitate separation of the connector from a mating connector (not shown). Shoulders 86 further define the axial limits of the spool portion, at one end thereof. A second pair of transversely extending projecting surfaces 87 spaced from and opposed to shoulders 86, are formed on cable body 14, to define, with shoulders 86, a recess forming a spool.

A transverse bridge 88 extends across the remote longitudinal ends of side walls 82 and floor webs 84 and is integrally formed with them to provide strength and support for the spool structure. A pair of spaced apart rectangular apertures 90 extend through the bridge 88 on either side of a central web 92. A pivot boss 94 extends from the bridge 88 perpendicularly to the plane of the spool portion to form the support for a transversely extending wing portion 96. The wing extends laterally in spaced relation to bridge 88 and overlies the apertures 90. Pivot boss 94 and wing portion 96 together define a capstan which may serve as an anchor for a conductor attached to the connector.

In use, a conductor may be coupled to the screw terminal 38 of a contact element 18, 20 and then guided to the exterior of the connector housing through recess 74 in contact receiving element 12. As it emerges from recess 74, a conductor may extend along recess 76 to the vicinity of bridge 88 where it may be wound around the pivot boss 94 beneath retaining wing 96 in the manner of a capstan, to relieve stress on the screw terminal 38.

It may be noted that for ease of fabrication, central web 92 and pivot boss 94 share common sidewalls forming one side of each of apertures 90, and the lateral extending portions of wing 96 are aligned with and congruent to apertures 90, so that molding dies may be inserted and withdrawn through the apertures easily to form the wing 96 in spaced relation to the apertures.

Figure 6:
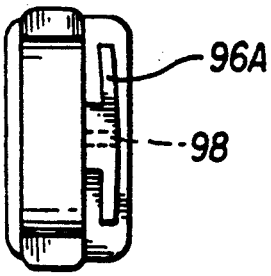
FIG. 6 is an end elevation view of the connector of FIG. 4 showing a different form of strain-relief capstan.

In an alternative embodiment, suggested in FIG. 6, a wing 96A may be formed separately of pivot boss 94 and then pivotally attached thereto by a pivot pin 98 inserted through a suitable pivot hole in the wing and anchored in boss 94. Pivotal movement of wing 96A allows it to be moved into and out of blocking, aligned relation with apertures 90. Such movement facilitates inserting a conductor through either one or both of apertures 90 to create a tortuous path for a conductor relative to the connector so as to achieve added stress relief and more secure mechanical anchoring of the conductor to the connector.

Figure 7:
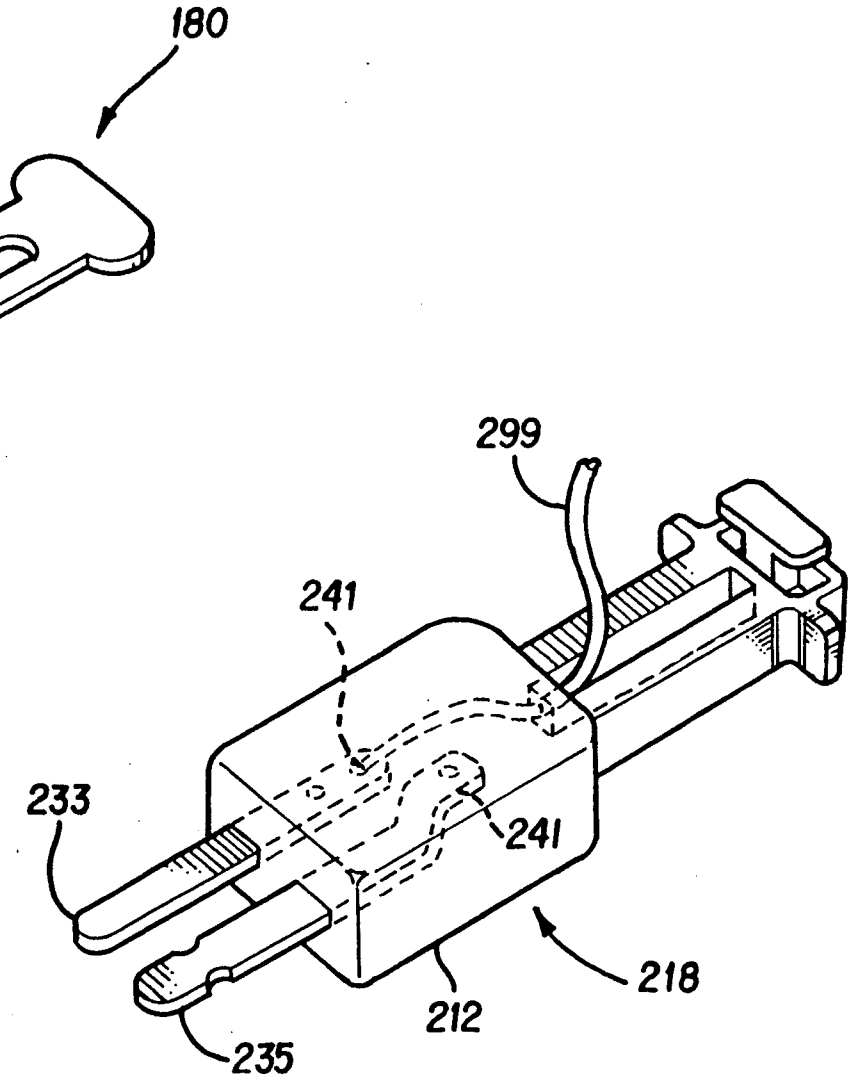
FIG. 7 is a pictorial representation of another embodiment of this invention having the entire body integrally molded in one piece.

In other alternative embodiments Connector 10 as shown in FIG. 1 can be an integrally insert molded connector as shown in FIG. 7, complete with male pins 133, 135, and beaded connector wire 199 electrically and mechanically coupled to contact 233 at point 241 within the molded one-piece body 212 in any well-known manner. It will be understood that the connection at 241 is made prior to formation of molded body 212 and will be substantially permanent thereafter. Alternatively a contact such as 235 may be integrally molded into body 212 and may be provided with an externally accessible contact terminal portion 218 for use as a separable conductor connector point, as explained in connection with the embodiment of FIG. 1. Or, the spool body portion 180 can be made from punched and formed flat stock, with the pivot boss 94 and the retaining wing 96 of FIG. 1 replaced by a cutout 194 having one leg running partially the length of the spool 180 from the top thereof, and a shorter cutout leg 196 directed back towards the top of the spool to provide the means for added stress relief and more secure mechanical anchoring of the conductor to the connector.

Figure 8:
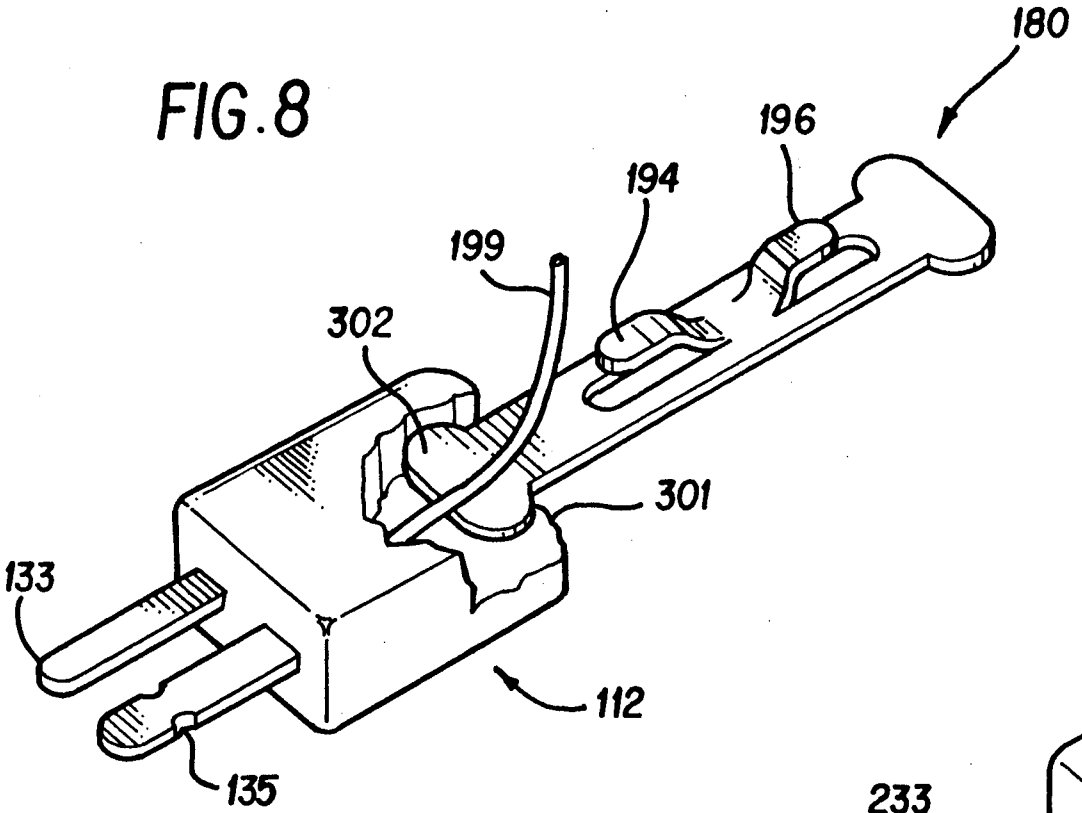
FIG. 8 is a pictorial representation of still another embodiment of this invention having two separate body portions integrally joined together, shown partially cut-away.

As shown in FIG. 8, the spool portion of the connector of this invention is integrally molded into the one piece body 112 and is provided with suitable projections 301, 302 to anchor the spool securely within the molded body, in a well-known manner. In this embodiment, as well as in FIG. 7, an integrally attached lead wire 199, 299 may be coupled to a contact 133, 135, 233, 235 within the molded body 112, 212, and may be directed to a suitable exit point in any well-known manner for cooperation with the external spool proportions, such as 180, in accordance with this invention.

Although a specific embodiment of this invention has been disclosed, it should be understood that various other and different forms and embodiments are possible within the scope of this disclosure and the following claims.

We claim:

1. An electrical connector, for coupling to the end of a flexible electrical cable having at least one electrical conductor for engagement with a mating connector, comprising:

an elongate housing, having a contact-supporting body portion of insulating material at one end thereof, and a cable-supporting body portion at the other end thereof separably attached to said contact-supporting body portion;

said contact-supporting body portion having a mating face for engaging a mating face on said cable-supporting body portion;

said cable-supporting body portion having a mating face lying in overlapping relationship with the mating face on said contact-supporting body portion;

each of said mating faces being generally parallel to the length of said housing, and at least one of said mating faces having a recess therein forming an exit passage for extending a conductor between said mating faces to the exterior of said housing;

said contact-supporting body portion having contact-exposing face with an opening therethrough for exposing a contact;

an electrical contact element supported on said contact-supporting body portion, and having a mating portion exposed through the opening in said contact exposing face;

coupling means on said contact-supporting body portion accessible at said mating face for coupling an electrical conductor to said electrical contact;

said cable-supporting body portion having a spool portion extending along the length thereof for winding an electrical cable thereon, and having an opening therein substantially transverse to the length of said housing through which the end of an electrical cable may be inserted to provide strain relief for resisting separation of said cable from said housing;

said spool portion having a longitudinal groove therein providing a path for a conductor along at least a portion of the length of said spool portion; and capstan means on said cable-supporting body portion adjacent to said opening and extending in overlying, spaced relationship thereto for limiting withdrawal of a cable from said opening.

2. An electrical connector, of the type which is coupled to the end of a flexible electrical cable having at least one electrical conductor for engagement with a mating connector, comprising:

an elongate housing, having a contact-supporting body portion of insulating material at one end thereof, and a cable-supporting body portion at the other end of thereof separably attached to said contact-supporting body portion;

said contact-supporting body portion having mating face for engaging a mating face on said cable-supporting body portion;

said cable-supporting body portion having a mating face lying in overlapping relationship with the mating face on said contact-supporting body portion;

each of said mating faces being generally parallel to the length of said housing;

said contact-supporting body portion having a contact-exposing face with an opening therethrough for exposing a contact;

an electrical contact element supported on said contact-supporting body portion, and having a mating portion exposed through the opening in said contact exposing face;

coupling means on said contact-supporting body portion accessible at said mating face for coupling an electrical conductor to said electrical contact;

said cable-supporting body portion having a spool portion extending along the length thereof for winding an electrical cable thereon, and having a pair of openings therein substantially transverse to the length of said housing through which the end of an electrical cable may be inserted in sequence to provide strain relief for resisting separation of said cable from housing; and capstan means on said cable-supporting body portion adjacent to said opening and extending in overlying, spaced relationship thereto for limiting withdrawal of a cable from said opening;

wherein said capstan means comprises a wing element and a central pivot element, said wing having a pair of projections extending in opposite directions from said central pivot element and mounted on said cable supporting body member such that said wing member is movable by rotation about said pivot element to move said projections into and out of blocking alignment with said pair of spaced apart openings to resist withdrawal of a cable from within said openings.

3. An electrical connector, of the type which is coupled to the end of a flexible electrical cable having at least one electrical conductor for engagement with a mating connector, comprising:

an elongate housing, having a contact-supporting body portion of insulating material at one end thereof, and a cable-supporting body portion at the other end thereof separably attached to said contact-supporting body portion;

said contact-supporting body portion having a mating face for engaging a mating face on said cable-supporting body portion;

said cable-supporting body portion having a mating face lying in overlapping relationship with the mating face on said contact-supporting body portion;

each of said mating faces being generally parallel to the length of said housing;

said contact-supporting body portion having a contact-exposing face with an opening therethrough for exposing a contact;

an electrical contact element supported on said contact-supporting body portion, and having a mating portion exposed through the opening in said contact exposing face;

coupling means on said contact-supporting body portion accessible at said mating face for coupling an electrical conductor to said electrical contact;

said cable-supporting body portion having a spool portion extending along the length thereof for winding an electrical cable thereon, and having an opening therein substantially transverse to the length of said housing through which the end of an electrical cable may be inserted to provide strain relief for resisting separation of said cable from said housing;

shoulder surface extending transversely from said spool portion at a location remote from said contact exposing face and facing in the direction of said contact-exposing face, to form an axial limit to one end of said spool portion and to provide a grip for an operator to withdraw said connector from engagement with a mating connector;

a projecting surface extending transversely from a side of said spool portion in opposing, spaced-apart relation to said shoulder surface, said shoulder surface and said projecting surface defining between them a recess for receiving and confining a cable wound around said spool portion and capstan means on said cable-supporting body portion adjacent to said opening and extending in overlying, spaced relationship thereto for limiting withdrawal of a cable from said opening.

4. An electrical connector, for coupling to the end of a flexible electrical cable having at least one electrical conductor for engagement with a mating connector, comprising:

an elongate housing, having a contact-supporting body portion of insulating material at one end thereof, and a cable-supporting body portion at the other end thereof integrally attached to said contact-supporting body portion;

said contact-supporting body portion having a contact-exposing face with an opening therethrough for exposing a contact:

an electrical contact element supported on said contact-supporting body portion, and having a mating portion exposed through the opening in said contact-exposing face;

coupling means on said contact-supporting body portion for coupling an electrical conductor to said electrical contact element;

said cable-supporting body having a spool portion extending along the length thereof for winding an electrical cable thereon, and having an opening therein substantially transverse to the length of said housing through which the end of an electrical cable may be inserted to provide strain relief for resisting separation of said cable from said housing; and capstan means on said cable-supporting body portion adjacent to said opening and extending in overlying, spaced relation thereto for limiting withdrawal of a cable from said opening;

wherein said contact-supporting body is formed of molded plastic;

said cable-supporting body portion comprises a formed sheet metal element partially embedded in said contact-supporting body portion;and said capstan means on said formed sheet metal element comprises at least one enlogated cutout portion formed to project above the surface of said sheet metal element.

* * * * *